US006009856A

United States Patent [19]

Smith, III et al.

[11] Patent Number: 6,009,856

[45] Date of Patent: Jan. 4, 2000

[54] FUEL INJECTOR ISOLATION

[75] Inventors: Ralph A. Smith, III, Bloomington, Ill.; Mike Youakim, Wauwatosa, Wis.

[73] Assignee: Caterpillar Inc., Peoria, Ill.

[21] Appl. No.: 09/085,550

[22] Filed: May 27, 1998

[51] Int. Cl.[7] ..... F02M 37/04

[52] U.S. Cl. ..... 123/470

[58] Field of Search ..... 123/41.31, 468, 123/469, 470, 541; 239/584, 585.4, 900; 137/375

[56] References Cited

U.S. PATENT DOCUMENTS

| | | | |
|---|---|---|---|
| 2,750,957 | 6/1956 | Tavola | 137/510 |
| 2,897,800 | 8/1959 | Haas . | |
| 3,382,851 | 5/1968 | Deluca . | |
| 3,717,305 | 2/1973 | Hedges | 239/288.5 |
| 3,841,277 | 10/1974 | Schafer . | |
| 3,924,583 | 12/1975 | Jardin . | |
| 4,066,213 | 1/1978 | Stampe | 239/600 |
| 4,307,693 | 12/1981 | Glockler et al. | 123/470 |
| 4,419,977 | 12/1983 | Hillebrand | 123/502 |
| 4,522,182 | 6/1985 | Mowbray | 123/509 |
| 4,589,596 | 5/1986 | Stumpp et al. | 123/470 |
| 5,002,480 | 3/1991 | Gellert et al. | 137/375 |
| 5,086,980 | 2/1992 | Hickey | 239/585 |
| 5,156,129 | 10/1992 | Sumida | 123/470 |
| 5,328,100 | 7/1994 | Bergstrom et al. | 239/585.4 |
| 5,345,913 | 9/1994 | Belshaw et al. | 123/470 |
| 5,365,907 | 11/1994 | Dietrich et al. | 123/470 |
| 5,752,487 | 5/1998 | Harrell et al. | 123/470 |

*Primary Examiner*—Thomas N. Moulis
*Attorney, Agent, or Firm*—Larry G. Cain

[57] ABSTRACT

Fuel injectors used in present day applications are normally requiring high pressure injection, short injection times and split or modified injection. Thus, this type of injection inherently produces an excess of noise. The present fuel injector assembly (22) overcomes the above deficiencies by controlling the noise emitted from a fuel injector (33). For example, as an actuation system (27) operates the fuel injector (33) the noise created by the opening and closing of the fuel injector (33) is absorbed within an isolator (34). As the fuel injector assembly (22) is installed, the fuel injector assembly (22) is positioned within a bore (26) with the fuel injector assembly being in a second position (29). And, a plurality of fasteners (28) are tightened to a predetermined value moving the fuel injector assembly (22) into a first position (24). Additionally, the fuel injector assembly (22) remains seated with respect to a cylinder (14) as the isolation material of the isolator (34) is biased positioning the fuel injector assembly (22) into the first position (24).

16 Claims, 2 Drawing Sheets

FUEL INJECTOR ISOLATION

TECHNICAL FIELD

Figure 1:
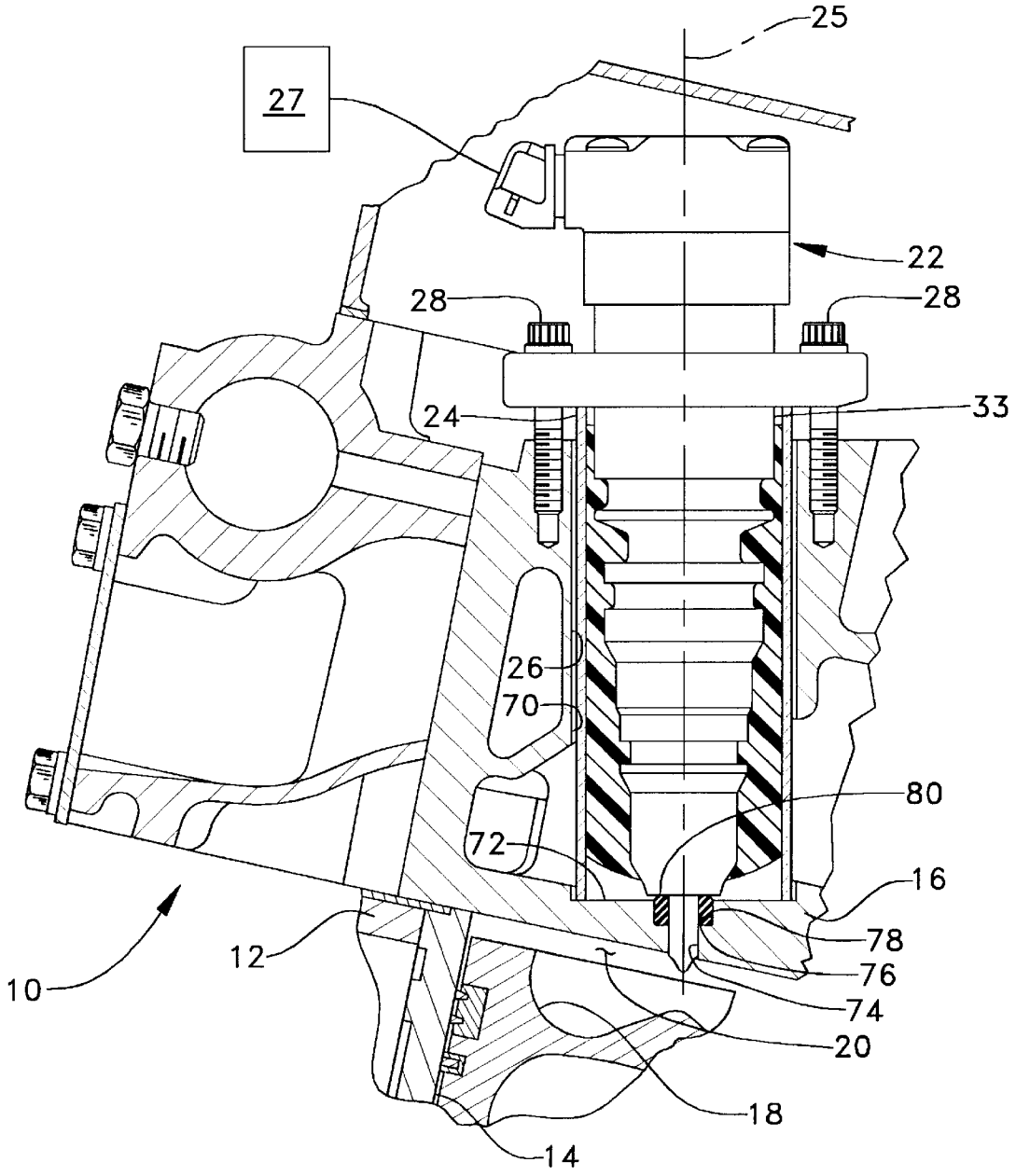

This invention relates generally to an engine and more particularly to an injector for supplying fuel to the engine.

BACKGROUND ART

The use of fossil fuel for combustion in an engines requires that the fuel be mixed with air and combustion occur. The combustion process results in rapid oxidation, causing noise, products of carbon monoxide, carbon dioxide, water vapor, smoke and particulates, unburned hydrocarbons, nitrogen oxides and sulfur oxides. In most applications, governmental imposed regulations are restricting the amount of pollutants, including noise, being emitted by the engine.

In the past, attempts to control noise emitted from the engine have included the use of add on shields and insulators. One such example is disclosed in U.S. Pat. No. 4,182,122 issued on Jan. 8, 1980 to Michael K. Stratton et al. With regard to noise emitted from a fuel injector, in many examples the fuel injector is positioned within a cover on the engine as is disclosed in U.S. Pat. No. 3,924,583 issued on Dec. 9, 1975 to Thomas K. Jardin. Thus, the noise emitted from the fuel injector is at least partially dampened by the head cover. However, with the increasing use of unit injectors and the use of higher pressures, split injection and other modes of operation the noise emitted from the fuel injector is, regardless of position within a head cover or open to atmosphere, increasing. With existing fuel injectors, noise created by such fuel injectors fails to be dampened.

Furthermore, as indicated above, present fuel injectors utilize higher injection pressures in an attempt to reduce a portion of the emissions. However, in reducing a portion of the emissions another portion of the emissions, noise is increased. Additionally, more sophisticated control and actuation systems are being used which also tend to increase the noise emitted from the injector. Thus, each of the above contributes to increased noise being emitted from the fuel injector.

The present invention is directed to overcoming one or more of the problems as set forth above.

DISCLOSURE OF THE INVENTION

In one aspect of the invention a fuel injector assembly has a first injector end, a body portion extending from the first injector end and a bracket connected with the body portion. The fuel injector assembly is comprised of a sleeve being spaced from the body portion and an insulator being interposed the body portion and the sleeve.

In another aspect of the invention a method of isolating noise from a fuel injector is disclosed. The fuel injector defines a first injector end, a body portion extending from the first injector end and a bracket attached to the body portion. The method is comprised of the steps of positioning a sleeve in a spaced relationship about the body portion and positioning an insulator within the spaced relationship.

In another aspect of the invention an engine has a block and a cylinder head being attached to the block. The block defines a cylinder therein and the cylinder head defines a stepped bore having a first bore therein, a second bore communicates between the first bore and the cylinder and a third bore defines a sealing surface. The engine is comprised of a fuel injector assembly positioned in the first bore. The fuel injector assembly includes a first injector end having a body portion extending therefrom and a bracket attached to the body portion. A sleeve is spaced from the body portion a preestablished distance and an isolator is interposed the body portion and the sleeve.

BRIEF DESCRIPTION OF THE INVENTION

Figure 2:
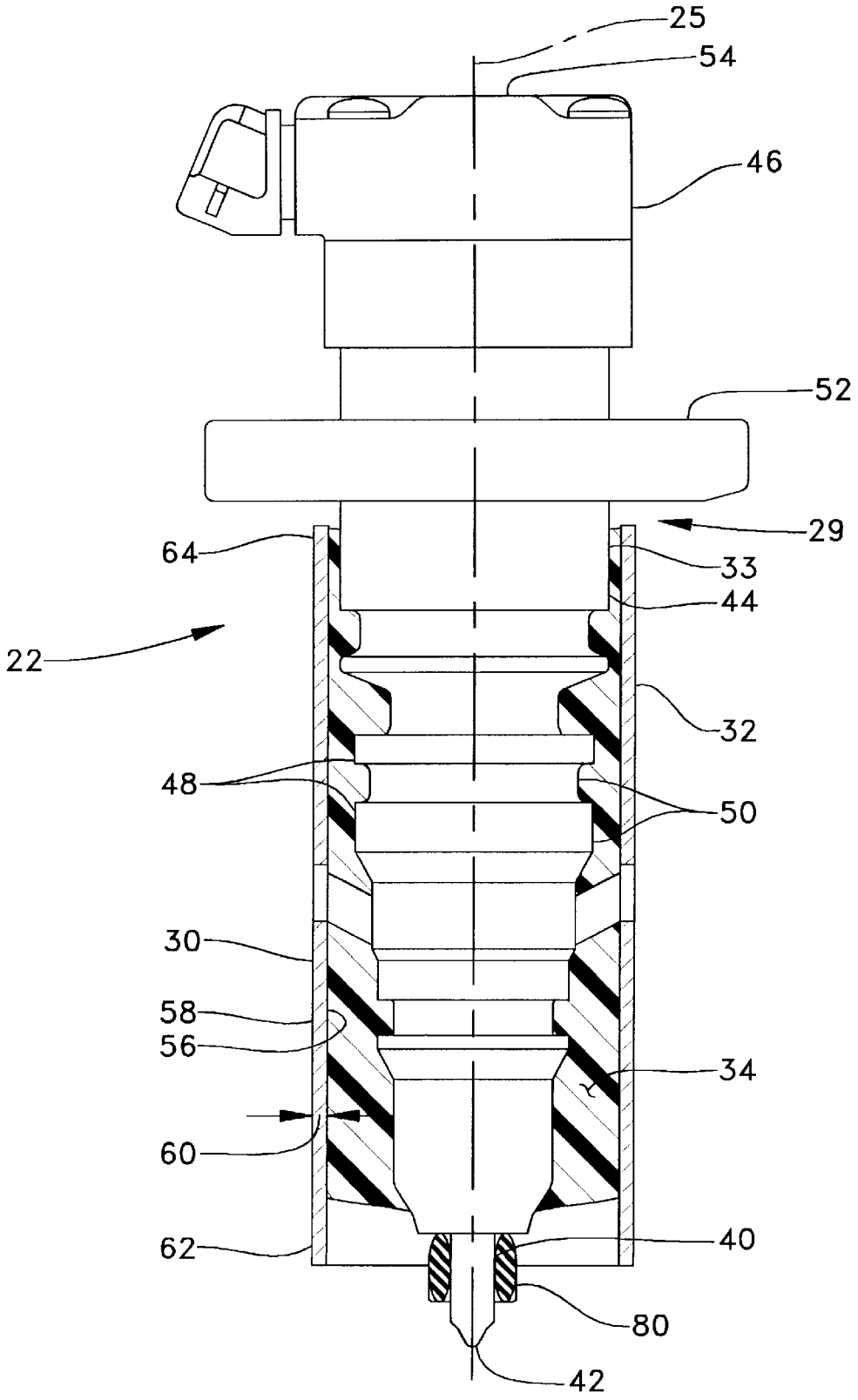

FIG. 1 is a partially cross-sectioned view of an internal combustion engine embodying the present invention and being assembled in the internal combustion engine; and FIG. 2 is an enlarged cross-sectional view of a fuel injector assembly embodying the present invention prior to being assembled in the internal combustion engine.

BEST MODE FOR CARRYING OUT THE INVENTION

Referring to FIG. 1, an internal combustion engine 10 includes a block 12 having a plurality of cylinders 14 therein, only one being shown. A cylinder head 16 is attached to the block 12 in a conventional manner. A conventional piston 18 is positioned within the respective one of the plurality of cylinders 14. The piston 18 is movable between a bottom dead center position and a bottom dead center position by a crankshaft in a conventional manner not shown. The movement of the piston 18 creates a compression area 20 interposed the piston 18, cylinder 14 and the cylinder head 16. A fuel injector assembly 22 is shown in an assembled or first position 24. The fuel injector assembly 22 defines an axis 25 and is positioned in a bore 26 in the cylinder head 16. In this application, the bore 26 has a stepped configuration as will be defined later. In the first position 24 the bore 26 is generally centered about the axis 25. Each of the respective plurality of cylinders 14 has a fuel injector assembly 22 communicating therewith. In this application, each of the fuel injector assemblies 22 is of the unit injector configuration and is actuated individually by a convention actuation system 27. The fuel injector assembly 22 is removably attached to the cylinder head 16 by a plurality of fasteners 28 being tightened to a preestablished value.

As further shown in FIG. 2, the fuel injector assembly 22 is shown in a free or second position 29. The fuel injector assembly 22 includes a housing assembly 30. The housing assembly 30 includes a sleeve 32 being spaced from a fuel injector 33 a preestablished distance and an insulator 34 positioned between the sleeve 32 and the fuel injector 33. The fuel injector 33, in this application, is of conventional construction and further includes a first injector end 40 being defined by a nozzle portion 42. A body portion 44 extends from the nozzle portion 42 to a second injector end 46. The body portion 44 has a generally serpentined configuration including a plurality of peaks 48 and valleys 50. As an alternative, the body portion 44 could be void of the serpentined configuration and have a generally smooth configuration without changing the jest of the invention. A mounting bracket 52 is positioned on the body portion 44. In this application, the second injector end 46 includes a solenoid or actuation device 54 being in operational communication with the actuation system 27.

The sleeve 32, in this application, has a generally cylindrical configuration defined by an inner diameter 56 and an outer diameter 58. However, as an alternative the sleeve 32 could have a square, triangular, or hexagonal configuration without changing the jest of the invention. Interposed the inner diameter 56 and the outer diameter is a wall thickness 60. The wall thickness 60 is between about 0.06 and 0.25 inches (1.5 and 6.4 mm). The sleeve 32 defines a first end 62 being spaced from the first injector end 40 a preestablished distance. A second end 64 of the sleeve 32 is spaced axially from the second injector end 46 a predetermined distance. The second end 64 of the sleeve 32 is positioned a spaced distance from the first end 62 and is spaced from the mounting bracket 52 a predetermined distance in the second position 29. For example, the second end 64 of the sleeve 32 is spaced from the mounting bracket 52 by a distance being about 0.25 to 0.50 inches (6.4 to 12.2 mm).

The insulator 34 includes a flexible material such as a rubber compound. The insulator 34 has a preestablished thickness being defined between the sleeve 32 and the body portion 44 of the fuel injector 33. In this application, the thickness is at least twice the thickness of the sleeve 32. Thus, the thickness of the insulator is, at its minimum thickness, about 0.50 inches (12.2 mm). The insulator 34 includes the following characteristics: (1) the material must act as a noise insulator, (2) the material must have an elastic quality with a memory, and (3) the material must have the capability to withstand the heat generated by the internal combustion engine 10. The bore 26 in the cylinder head 16 includes a first bore 70 having a diameter being slightly larger than the outer diameter 58 of the sleeve 32. The first bore 70 defines a surface 72. A second bore 74 is centrally located with respect to the first bore 70 and the axis 25, and communicates with the cylinder 14. A third bore 76 has a preestablished diameter and a preestablished depth. The third bore 76 defines a sealing surface 78 at the end of the depth. A seal 80 is positioned within the third bore 76

Other aspects, objects and advantages of this invention can be obtained from a study of the drawings, the disclosure and the appended claims.

INDUSTRIAL APPLICABILITY

In use the present fuel injector assembly 22 reduces noise emitted therefrom. For example, in the second position 29, the second end 64 of the sleeve 32 is spaced from the bracket assembly 52, the insulator 34 is bonded to the inner diameter 56 of the sleeve 32 and the insulator 34 is interposed the peaks 48 and valleys 50 of the generally serpentined configuration of the body portion 44. As an alternative, the insulator could also be bonded to the body portion 40.

With the fuel injector assembly 22 in the free position 29 and prior to assembly of the fuel injector assembly 22 within the internal combustion engine 10 the seal 80 is positioned about the first injector end 40. The fuel injector assembly 22 is then positioned within the stepped bore 24. The seal 80 is positioned within the third bore 76. And, the first end 62 of the sleeve 32 is positioned in the first bore 70 and the first end 62 is in contact with the surface 72 of the first bore 70. The plurality of fasteners 28 attaching the fuel injector assembly 22 to the cylinder head 16 are installed. As the plurality of fasteners 28 are tightened, the seal 80 is forced into sealing relationship in such a manner that the seal 80 contacts the sealing surface 78 of the third bore 76 and the first injector end 44. Additionally, as the plurality of fasteners 28 are tightened the bracket 52, the first injector end 40, the second injector end 46 and the body portion 44 are forced toward the surface 72 of the first bore 70. Thus, the isolator 34 is biased and maintains the seal 80 within sealing relationship between the sealing surface 78 and the first injector end 40 of the fuel injector 33. As the plurality of fasteners 28 are tightened to the predetermined value, a force is applied to the sleeve 32. For example, the bracket 52 exerts a force on the second end 64 of the sleeve 32 which is transferred through the sleeve 32 to the first end 62 of the sleeve 32. Thus, the fuel injector assembly 22 is in the second position 29. And, the first end 62 of the sleeve 32 is in forced relationship with the surface 72 of the first bore 70, the seal 80 is in sealing relationship with the first injector end 40 and sealing surface 78 of the third bore 76 of the cylinder head 16, and the isolator 34 is biased.

As the internal combustion engine 10 is operated, the fuel injector assembly 22 directs fuel into each of the plurality of cylinders 14. With the insulator 34 positioned between the sleeve 32 and the body portion 44. Noise caused by the injection process is dampened from being emitted to the atmosphere.

What is claimed is:

1. A fuel injector assembly having a first injector end, a body portion extending from said first injector end and a bracket being connected with said body portion; said fuel injector assembly comprising:

a sleeve being spaced from said body portion; and an insulator being interposed said body portion and said sleeve, said insulator being bonded to said sleeve.

2. The fuel injector assembly (22) of claim 1 wherein said body portion (44) defines a plurality of peaks (48) and valleys (50) and said insulator (34) being positioned about said peaks (48) and said valleys (50).

3. The fuel injector assembly (22) of claim 2 wherein said sleeve (32) defines a first end (62) and a second end (64) and said bracket (52) being spaced from said second end (64) of said sleeve (32) by a preestablished distance.

4. The fuel injector assembly (22) of claim 3 wherein said preestablished distance is in the range of between about 0.25 to 0.50 inches (6.4 to 12.2 mm).

5. The fuel injector assembly (22) of claim 2 wherein said sleeve (32) has a preestablished thickness and said insulator (34) has a preestablished thickness being at least twice that of the thickness of the sleeve (32).

6. A method of isolating noise from a fuel injector, said fuel injector defining a first injector end, a body portion extending from the first injector end and a bracket being attached to said body portion; comprising the steps of:

positioning a sleeve in a spaced relationship about said body portion, said positioning said sleeve about said body portion including said spaced relationship defining a preestablished thickness of said insulator, said preestablished thickness being in a range of about 0.50 inches (12.2 mm); and positioning an insulator within said spaced relationship.

7. The method of isolating noise from the fuel injector (33) of claim 6 wherein said positioning the insulator (34) within said spaced relationship includes said insulator (34) being bonded to said sleeve (32).

8. The method of isolating noise from the fuel injector (33) of claim 7 wherein positioning the sleeve (32) includes said sleeve (32) being spaced from said bracket (52) a preestablished distance.

9. The method of isolating noise from the fuel injector (33) of claim 8 wherein said preestablished distance between said sleeve (32) and said bracket (52) being in a range of about 0.25 to 0.50 inches (6.4 to 12.2 mm).

10. The method of isolating noise from the fuel injector (33) of claim 9 further including positioning a seal (80) on said first injector end (40).

11. An engine (10) having a block (12) and a cylinder head (14) being attached to said block (12), said block (12) defining a cylinder (14) therein and said cylinder head (14) defining a bore (26) having a first bore (70) therein, a second bore (74) communicating between said first bore (70) and said cylinder (14) and a third bore (76) defining a sealing surface (78); said engine comprising:

a fuel injector (33) being positioned in said first bore (70), said fuel injector (22) including a first injector end (40) having a body portion (44) extending therefrom and a bracket (52) being attached to said body portion (44);

a sleeve (32) being spaced from said body portion (44) a preestablished distance; and an isolator (34) being interposed said body portion (44) and said sleeve (32).

12. The engine (10) of claim 11 wherein said insulator (34) is bonded to said sleeve (32).

13. The engine (10) of claim 11 wherein said body portion (44) defines a plurality of peaks (48) and valleys (50) and said insulator (34) being positioned about said peaks (48) and said valleys (50).

14. The engine (10) of claim 11 wherein said sleeve (32) defines a first end (62) and a second end (64) and said bracket (52) being spaced from said second end (64) of said sleeve (32) by a preestablished distance.

15. The engine (10) of claim 14 wherein said preestablished distance is in the range of between about 0.25 to 0.50 inches (6.4 to 12.2 mm).

16. The engine (10) of claim 11 wherein said sleeve (32) has a preestablished thickness and said insulator (34) has a preestablished thickness being at least twice that of the thickness of the sleeve (32).

* * * * *